US012305141B2

(12) United States Patent
Vincent et al.

(10) Patent No.: US 12,305,141 B2
(45) Date of Patent: May 20, 2025

(54) ZINC FREE LUBRICATING COMPOSITIONS AND METHODS OF USING THE SAME

(71) Applicant: The Lubrizol Corporation, Wickliffe, OH (US)

(72) Inventors: Paul R. Vincent, Belper (GB); William R. S. Barton, Belper (GB); Emma Fahey, Belper (GB); Yanshi Zhang, Solon, OH (US); Mark C. Davies, Derby (GB); Ewan E. Delbridge, Victoria (AU)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/285,004

(22) PCT Filed: Apr. 1, 2022

(86) PCT No.: PCT/US2022/023053

§ 371 (c)(1),
(2) Date: Sep. 29, 2023

(87) PCT Pub. No.: WO2022/212844

PCT Pub. Date: Oct. 6, 2022

(65) Prior Publication Data

US 2024/0199974 A1 Jun. 20, 2024

Related U.S. Application Data

(60) Provisional application No. 63/169,445, filed on Apr. 1, 2021.

(51) Int. Cl.

| | |
|---|---|
| ***C10M 169/04*** | (2006.01) |
| ***C10M 133/12*** | (2006.01) |
| ***C10M 135/04*** | (2006.01) |
| ***C10M 135/10*** | (2006.01) |
| ***C10M 135/18*** | (2006.01) |
| ***C10M 137/04*** | (2006.01) |
| ***C10M 137/08*** | (2006.01) |
| ***C10M 137/10*** | (2006.01) |
| ***C10M 141/10*** | (2006.01) |
| ***C10M 149/02*** | (2006.01) |
| ***C10M 155/00*** | (2006.01) |
| ***C10M 157/10*** | (2006.01) |
| ***C10M 161/00*** | (2006.01) |
| *C10N 30/00* | (2006.01) |
| *C10N 30/04* | (2006.01) |
| *C10N 30/06* | (2006.01) |
| *C10N 30/10* | (2006.01) |
| *C10N 40/25* | (2006.01) |

(52) U.S. Cl.

CPC ..... *C10M 169/044* (2013.01); *C10M 133/12* (2013.01); *C10M 135/04* (2013.01); *C10M 135/10* (2013.01); *C10M 135/18* (2013.01); *C10M 137/04* (2013.01); *C10M 137/08* (2013.01); *C10M 137/10* (2013.01); *C10M 137/105* (2013.01); *C10M 141/10* (2013.01); *C10M 149/02* (2013.01); *C10M 155/00* (2013.01); *C10M 157/10* (2013.01); *C10M 161/00* (2013.01); *C10M 2203/003* (2013.01); *C10M 2215/26* (2013.01); *C10M 2217/06* (2013.01); *C10M 2219/022* (2013.01); *C10M 2219/046* (2013.01); *C10M 2219/068* (2013.01); *C10M 2223/043* (2013.01); *C10M 2223/045* (2013.01); *C10M 2223/047* (2013.01); *C10M 2223/049* (2013.01); *C10M 2229/00* (2013.01); *C10N 2030/041* (2020.05); *C10N 2030/06* (2013.01); *C10N 2030/10* (2013.01); *C10N 2030/40* (2020.05); *C10N 2040/25* (2013.01)

(58) Field of Classification Search

CPC ..... C10M 169/044; C10M 133/12; C10M 135/04; C10M 135/10; C10M 135/18; C10M 137/04; C10M 137/08; C10M 137/10; C10M 137/105; C10M 141/10; C10M 149/02; C10M 155/00; C10M 157/10; C10M 161/00; C10N 2030/40

See application file for complete search history.

(56) References Cited

U.S. PATENT DOCUMENTS

| | | | |
|---|---|---|---|
| 3,172,892 | A | 3/1965 | Le Suer |
| 3,197,405 | A | 7/1965 | Le Suer |
| 3,219,666 | A | 11/1965 | Norman |
| 3,316,177 | A | 4/1967 | Dorer, Jr. |
| 3,340,281 | A | 9/1967 | Brannen, Jr. |

(Continued)

FOREIGN PATENT DOCUMENTS

| | | |
|---|---|---|
| EP | 0355895 | 1/1991 |
| WO | 20060015130 | 2/2006 |
| WO | 20060047486 | 5/2006 |
| WO | 20080147704 | 12/2008 |

(Continued)

*Primary Examiner* — Ellen M McAvoy

(74) *Attorney, Agent, or Firm* — Eryn A. Fuhrer; Michael A. Miller

(57) ABSTRACT

The instant disclosure generally relates to lubricating compositions having an oil of lubricating viscosity, an ashless phosphorus-containing antiwear agent an alkaline earth metal detergent, an ashless antioxidant, and an ashless dispersant where the lubricating compositions are substantially free of zinc and methods of lubricating an engine with such lubricating compositions. The instant lubricating compositions are useful as alternative lubricating compositions the reduce and/or eliminate zinc to achieve a desired performance goal of the lubricating composition.

25 Claims, No Drawings

(56) References Cited

U.S. PATENT DOCUMENTS

| | | | |
|---|---|---|---|
| 3,351,552 | A | 11/1967 | Le Suer |
| 3,381,022 | A | 4/1968 | Le Suer |
| RE26,433 | E | 8/1968 | Le Suer |
| 3,433,744 | A | 3/1969 | Le Suer |
| 3,444,170 | A | 5/1969 | Norman et al. |
| 3,467,668 | A | 9/1969 | Gruber et al. |
| 3,501,405 | A | 3/1970 | Willette |
| 3,542,680 | A | 11/1970 | Le Suer |
| 3,544,465 | A | 12/1970 | Braid |
| 3,576,743 | A | 4/1971 | Widmer et al. |
| 3,632,511 | A | 1/1972 | Liao |
| 3,634,515 | A | 1/1972 | Piasek et al. |
| 4,234,435 | A | 11/1980 | Meinhardt et al. |
| 4,670,169 | A | 6/1987 | Adams et al. |
| 4,770,807 | A | 9/1988 | Musikas et al. |
| 4,863,623 | A | 9/1989 | Nalesnik |
| 4,876,374 | A | 10/1989 | Adams et al. |
| 6,107,257 | A | 8/2000 | Valcho et al. |
| 6,107,258 | A | 8/2000 | Esche, Jr. et al. |
| 6,117,825 | A | 9/2000 | Liu et al. |
| 6,153,565 | A | 11/2000 | Skinner et al. |
| 6,165,235 | A | 12/2000 | Kolp et al. |
| 6,281,179 | B1 | 8/2001 | Skinner et al. |
| 6,429,178 | B1 | 8/2002 | Skinner et al. |
| 6,429,179 | B1 | 8/2002 | Skinner et al. |
| 7,009,072 | B2 | 3/2006 | Muir |
| 7,238,650 | B2 | 7/2007 | Calder et al. |
| 7,285,516 | B2 | 10/2007 | Carrick et al. |
| 7,407,919 | B2 | 8/2008 | Wilk et al. |
| 7,615,521 | B2 | 11/2009 | Eveland et al. |
| 7,772,171 | B2 | 8/2010 | Al-Ahmad et al. |
| 8,399,388 | B2 | 3/2013 | Campbell et al. |
| 8,557,753 | B2 | 10/2013 | Gieselman et al. |
| 8,637,437 | B2 | 1/2014 | Gieselman et al. |
| 2005/0038319 | A1 | 2/2005 | Goldwasser et al. |
| 2010/0197536 | A1 | 8/2010 | Mosier et al. |
| 2017/0015933 | A1* | 1/2017 | Fletcher ..... C10M 129/02 |
| 2018/0201862 | A1* | 7/2018 | Delbridge ..... C10M 169/044 |
| 2019/0078035 | A1* | 3/2019 | Kassir ..... C10M 137/08 |
| 2019/0225911 | A1* | 7/2019 | Sutton ..... C10M 161/00 |
| 2019/0241824 | A1* | 8/2019 | Barton ..... C10M 137/08 |
| 2020/0048573 | A1* | 2/2020 | Filippini ..... C10M 137/10 |

FOREIGN PATENT DOCUMENTS

| | | |
|---|---|---|
| WO | 20140074335 | 5/2014 |
| WO | 20150171356 | 11/2015 |
| WO | 20170083546 | 5/2017 |

* cited by examiner

ZINC FREE LUBRICATING COMPOSITIONS AND METHODS OF USING THE SAME

CROSS REFERENCE TO RELATED APPLICATION

This application claims priority from PCT Application Serial No. PCT/US2022/023053 filed on Apr. 1, 2022, which claims the benefit of U.S. Provisional Application No. 63/169,445 filed on Apr. 1, 2021, both of which are incorporated in their entirety by reference herein.

BACKGROUND

Modern engine designs are being developed to improve fuel economy without sacrificing performance or durability. Historically, gasoline was port-fuel injected (PFI), that is, injected through the air intake and entering the combustion chamber via the air intake valve. Gasoline direct injection (GDI) involves direct injection of gasoline into the combustion chamber.

In certain situations, the internal combustion engine may exhibit abnormal combustion. Abnormal combustion in a spark-initiated internal combustion engine may be understood as an uncontrolled explosion occurring in the combustion chamber as a result of ignition of combustible elements therein by a source other than the igniter.

Pre-ignition may be understood as an abnormal form of combustion resulting from ignition of the air-fuel mixture prior to ignition by the igniter. Anytime the air-fuel mixture in the combustion chamber is ignited prior to ignition by the igniter, such may be understood as pre-ignition.

It is now known that zinc containing antiwear agents such as ZDDP have been shown to reduce and/or mitigate LSPI in direct injection engines. However, zinc containing antiwear agents contribute to the sulfated ash of the lubricating composition. Zinc containing antiwear agents also contribute to particulate matter in the lubricating composition and such particulate matter may affect cleanliness, deposit formation, fuel economy, and emissions quality. Moreover, zinc antiwear agents have come under environmental scrutiny. As such there is a desire to reduce or eliminate zinc antiwear agents with zinc free alternatives that have the desired performance outcome.

As such, there is continued need for evolving lubricant compositions that reduce and/or eliminate zinc with ashless alternatives to achieve a desired performance goal of the lubricant.

The disclosed lubricant compositions address one or more of the foregoing concerns, including reducing or mitigating LSPI, by employing a lubricant composition having at least an ashless phosphorous containing antiwear agent.

SUMMARY

The instant disclosure relates to a lubricating composition and methods of lubricating an engine with said lubricating composition. The lubricating composition includes a base oil of lubricating viscosity, an ashless phosphorous containing antiwear agent, an alkaline earth metal detergent, an ashless antioxidant and an ashless dispersant. The lubricating composition is further defined by being substantially free of zinc. The ashless phosphorous containing antiwear agent described in the foregoing composition may include an alkyl phosphate amine salt.

The instant disclosure further includes lubricating compositions having a base oil of lubricating viscosity, an alkyl phosphate amine salt antiwear agent having at least 30 mole percent of the phosphorous atoms in the pyrophosphate salt structure an in an amount to deliver 500 ppm to 900 ppm of phosphorous to the lubricating composition, an alkaline earth metal detergent selected includes a calcium sulfonate detergent and a magnesium sulfonate detergent, an ashless antioxidant includes an alkylated diarylamine and a sulfurized olefin, and an ashless dispersant including a polyisobutylene succinimide dispersant and a borated polyisobutylene succinimide dispersant, wherein the lubricating composition is substantially free of zinc.

The instant disclosure further relates to methods of reducing Low Speed Preignition ("LSPI") in a spark-ignited direct injection internal combustion engine operated under a load with a brake mean effective pressure (BMEP) of greater than or equal to 10 bars at speeds less than or equal to 3,000 rpm by supplying to the engine a lubricating composition including a base oil of lubricating viscosity, an ashless phosphorous containing antiwear agent, an alkaline earth metal detergent, an ashless antioxidant and an ashless dispersant. The lubricating composition is further defined by being substantially free of zinc.

The instant disclosure further relates to methods of reducing LSPI in a spark-ignited direct injection internal combustion engine operated under a load with a brake mean effective pressure (BMEP) of greater than or equal to 10 bars at speeds less than or equal to 3,000 rpm by supplying to the engine a lubricating composition having a base oil of lubricating viscosity, an alkyl phosphate amine salt antiwear agent having at least 30 mole percent of the phosphorous atoms in the pyrophosphate salt structure an in an amount to deliver 500 ppm to 900 ppm of phosphorous to the lubricating composition, an alkaline earth metal detergent selected includes a calcium sulfonate detergent and a magnesium sulfonate detergent, an ashless antioxidant includes an alkylated diarylamine and a sulfurized olefin, and an ashless dispersant including a polyisobutylene succinimide dispersant and a borated polyisobutylene succinimide dispersant, wherein the lubricating composition is substantially free of zinc.

The instant disclosure further the use of a lubricating composition including a base oil of lubricating viscosity, an ashless phosphorous containing antiwear agent, an alkaline earth metal detergent, an ashless antioxidant and an ashless dispersant, where the lubricating composition is further defined by being substantially free of zinc for reducing LSPI in a spark-ignited direct injection internal combustion engine operated under a load with a brake mean effective pressure (BMEP) of greater than or equal to 10 bars at speeds less than or equal to 3,000 rpm.

The instant disclosure further relates to the use of a lubricating composition including a base oil of lubricating viscosity, an alkyl phosphate amine salt antiwear agent having at least 30 mole percent of the phosphorous atoms in the pyrophosphate salt structure an in an amount to deliver 500 ppm to 900 ppm of phosphorous to the lubricating composition, an alkaline earth metal detergent selected includes a calcium sulfonate detergent and a magnesium sulfonate detergent, an ashless antioxidant includes an alkylated diarylamine and a sulfurized olefin, and an ashless dispersant including a polyisobutylene succinimide dispersant and a borated polyisobutylene succinimide dispersant, wherein the lubricating composition is substantially free of zinc for reducing LSPI in a spark-ignited direct injection internal combustion engine operated under a load with a brake mean effective pressure (BMEP) of greater than or equal to 10 bars at speeds less than or equal to 3,000 rpm.

DETAILED DESCRIPTION

The instant disclosure relates to substantially zinc free lubricating compositions and methods of using the same. The instant lubricating compositions include a base oil of lubricating viscosity; an ashless phosphorus-containing antiwear agent; an alkaline earth metal detergent; an ashless antioxidant; and an ashless dispersants. The lubricating compositions are substantially free of zinc. The instant disclosure further includes methods of using the lubricating compositions to reduce low speed pre-ignition ("LSPI") in engines operating under conditions that favor an LSPI event.

Oils of Lubricating Viscosity

One component of the disclosed compositions is an oil of lubricating viscosity. As used herein, an oil of lubricating viscosity may include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). The cited portions of both references are incorporated herein. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Suitable oils may be produced from biological, i.e. natural, sources or by bio-engineered processes. This includes both natural occurring oils, such as vegetable oils and triglyceride oils that may be further refined or purified by standard processes, and those oils that may be derived by biological conversion of a natural chemical into oil directly or by bio-formation of building block pre-cursor molecules capable of being further converted into oil by known processes.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10), which are incorporated herein by reference.

In one embodiment the oil of lubricating viscosity may be an API Group I to IV mineral oil, an ester or a synthetic oil, or mixtures thereof. In one embodiment the oil of lubricating viscosity may be an API Group II, Group III, Group IV mineral oil, an ester or a synthetic oil, or mixtures thereof.

The amount of the oil of lubricating viscosity present is typically the balance remaining after subtracting from 100 wt % the sum of the amount of the dispersant additive package according to the instant disclosure and additional, if any, additives. In some embodiments, the oil of lubricating viscosity may be from 80 to 95 wt % of the lubricating compositions. In other embodiments, the oil of lubricating viscosity may be from 80 to 90 wt % of the lubricating composition.

In the present disclosure, the oil of lubricating viscosity may have a kinematic viscosity measured at 100° C. of 2.4 $m^2/s$ to 6.4 $m^2/s$. In some embodiments, the kinematic viscosity is from 4.0 $m^2/s$ to 5.0 $m^2/s$ or from 5.2 $m^2/s$ to 5.8 $m^2/s$ or from 6.0 $m^2/s$ to 6.5 $m^2/s$. In other embodiments, the kinematic viscosity is 6.2 $m^2/s$ or 5.6 $m^2/s$ or 4.6 $m^2/s$.

The lubricating composition claimed herein may be in the form of a concentrate and/or a fully formulated lubricant. If the lubricating composition is in the form of a concentrate (which may be combined with additional oil to form, in whole or in part, a finished lubricant), the ratio of the components disclosed herein to the oil of lubricating viscosity and/or to diluent oil include the ranges of 1:99 to 99:1 by weight, or 80:20 to 10:90 by weight.

Ashless Phosphorus-Containing Antiwear Agent

The lubricating compositions disclosed herein further include an ashless phosphorus-containing antiwear agent. In one embodiment, the ashless phosphorus-containing antiwear agent is an organo-phosphorous compound. Suitable ashless phosphorus-containing antiwear agents include phosphites, (thio)phosphate, (thio)phosphate amine salts, and combinations thereof. In some embodiments, the ashless phosphorus-containing antiwear agent may also contain sulfur atoms. In other embodiments, the phosphorus-containing antiwear agent is free of or substantially free of sulfur. In one embodiment, when present the sulfur content of the phosphorus-containing antiwear agent is such that the weight ratio of sulfur to phosphorus is less than 2 to 1, or less than 1.75 to 1.

In one embodiment, the ashless phosphorus-containing antiwear agent is phosphite. Suitable phosphites include those having at least one hydrocarbyl group with 3 or more, or 8 or more, or 12 or more, carbon atoms. The phosphite may be a mono-hydrocarbyl substituted phosphite, a di-hydrocarbyl substituted phosphite, or a tri-hydrocarbyl substituted phosphite. The phosphite may be represented by the formulae:

I

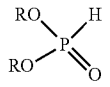

II

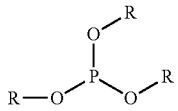

wherein at least one R may be a hydrocarbyl group containing at least 3 carbon atoms and the other R groups may be hydrogen. In one embodiment, two of the R groups are hydrocarbyl groups, and the third is hydrogen. In one embodiment every R group is a hydrocarbyl group, i.e., the phosphite is a tri-hydrocarbyl substituted phosphite. The hydrocarbyl groups may be alkyl, cycloalkyl, aryl, acyclic or mixtures thereof. The R hydrocarbyl groups may be linear or branched, typically linear, and saturated or unsaturated, typically saturated. In one embodiment, the phosphite is a phosphite according to formula I wherein R is selected from a $C_{18}$ hydrocarbyl, a phenyl moiety, a $C_{14}$ to $C_{18}$ alkyl or combinations thereof.

In one embodiment, the ashless phosphorus-containing antiwear agent can be a $C_{12-22}$ hydrocarbyl phosphite, or mixtures thereof, i.e., wherein each R may independently be hydrogen or a hydrocarbyl group having 12 to 24, or 14 to 20 carbon atoms, typically 16 to 18 carbon atoms. Typically, the $C_{12-22}$ hydrocarbyl phosphite comprises a $C_{16-18}$ hydrocarbyl phosphite. Examples of alkyl groups for $R^3$, $R^4$ and $R^5$ include octyl, 2-ethylhexyl, nonyl, decyl, undecyl, dodecyl, tridecyl, tetradecyl, pentadecyl, hexadecyl, heptadecyl, octadecyl, octadecenyl, nonadecyl, eicosyl or mixtures thereof. In another embodiment, the phosphite can be a $C_{3-8}$ hydrocarbyl phosphite, or mixtures thereof, i.e., wherein each R may independently be hydrogen or a hydrocarbyl group having 3 to 8, or 4 to 6 carbon atoms, typically 4 carbon atoms. Typically, the $C_{3-8}$ hydrocarbyl phosphite comprises dibutyl phosphite.

Phosphites used herein may further include a phosphite ester. Phosphite esters include reaction products of (a) a monomeric phosphorous acid or an ester thereof with (b) at least two alkylene diols: a first alkylene diol (i) having two hydroxy groups in a 1,4 or 1,5 or 1,6 relationship; and a second alkylene diol (ii) being an alkyl-substituted 1,3-propylene diol with one or more of the alkyl substituents thereof being on one or more of the carbon atoms of the propylene unit, the total number of carbon atoms in the alkyl-substituted 1,3-propylene diol being 5 or 6 to 12; the relative molar mounts of monomeric phosphorous acid or ester thereof (a) and the total of the alkylene diols (b) being in a ratio of 0.9:1.1 to 1.1:0.9; and the relative molar amounts of the first alkylene diol (i) and the alkyl-substituted 1,3-propylene diol (ii) being in a ratio of 30:70 to 65:35.

Phosphites used herein may further include sulfur containing phosphites. Suitable sulfur containing phosphites include those represented by the formula:

(III)

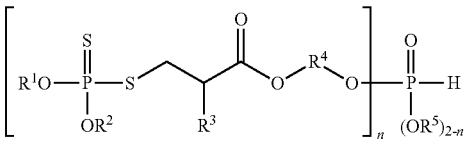

wherein $R^1$ and $R^2$ are each independently hydrocarbyl groups of 3 to about 12 carbon atoms, or 6 to 8 carbon atoms, or are groups represented by (IV)

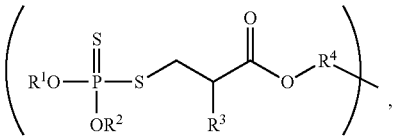

or wherein $R^1$ and $R^2$ together with the adjacent O and P atoms form a ring containing 2 to 6 carbon atoms; $R^3$ is hydrogen or a methyl group, $R^4$is an alkylene group of 2 to 6 carbon atoms, $R^5$ is hydrogen or a hydrocarbyl group of 1 to about 12 carbon atoms, and n is 1 or 2.

In another embodiment, the ashless phosphorus-containing antiwear agent may be a (thio)phosphate. Where the term "thio" is in a parenthetical preceding the chemical identifier, it is understood that the thio group is optional. Thus, for example, "(thio)phosphate" includes both phosphate and thiophosphate compounds.

In one embodiment, the (thio)phosphate is a ditiophosphate ester. Suitable dithiophosphate esters can be formed by reaction of a dithiophosphoric acid represented by $(RO)_2PSSH$ with an unsaturated compound. In one embodiment, the unsaturated compounds is an unsaturated carboxylic acid or ester. Examples of unsaturated carboxylic acids or anhydrides include acrylic acids or esters, methacrylate acid or esters, itaconic acid or ester, fumaric acid or esters, and maleic acid, anhydride, or esters.

An example of a (thio)phosphate includes phosphorus-containing amide esters which may be prepared by the reaction of phosphorus acids, such as dithiophosphoric acid, with an unsaturated amide. Examples of unsaturated amides include acrylamide, N,N'-methylene bisacrylamide, methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In another embodiment, the ashless phosphorus-containing antiwear agent may be a (thio)phosphate amine salt. In one embodiment, the (thio)phosphate amine salt is an amine alkylthiophosphate, in which the alkylthiophosphate is reacted with an epoxide or a polyhydric alcohol, such as glycerol. The reaction product may be used alone, or further reacted with a phosphorous acid, anhydride, or lower ester. The epoxide is generally an aliphatic epoxide, or a styrene oxide. Examples of useful epoxides include ethylene oxide, propylene oxide, butene oxide, octene oxide, dodecane oxide, styrene oxide, etc. Ethylene oxide and propylene oxide are preferred. The polyhydric alcohols may be aliphatic glycols having from 1 to about 12, or from about 2 to about 6, or from 2 or 3 carbon atoms. Glycols include ethylene glycol, propylene glycol, and the like. The alkythiophosphate, glycols, epoxides, inorganic phosphorous reagents and methods of reacting the same are described in U.S. Pat. Nos. 3,197,405 and 3,544,465 which are incorporated herein by reference.

In another embodiment, the (thio)phosphate amine salt includes an amine salt of a phosphate hydrocarbon ester prepared by reaction between phosphorous pentoxide with an alcohol (having 4 to 28 carbon atoms), followed by a reaction with a primary (e.g., 2-ethylhexylamine), secondary (e.g., dimethylamine), or tertiary (e.g. dimethyloleylamine) amine to form an amine salt of a phosphate hydrocarbon ester. Suitable alcohols include those containing up to 30 or to 24, or to 12 carbon atoms, including primary or secondary alcohols such as isopropyl, butyl, amyl, s-amyl, 2-ethylhexyl, hexyl, cyclohexyl, octyl, decyl and oleyl alcohols, as well as any of a variety of commercial alcohol mixtures having, e.g., 8 to 10, 12 to 18, or 18 to 28 carbon atoms.

In another embodiment, the (thio)phosphate amine salt includes a substantially sulfur-free alkyl phosphate amine salt. The alkyl phosphate amine salt has at least 30 mole percent of the phosphorus atoms are in an alkyl pyrophosphate structure, as opposed to an orthophosphate (or monomeric phosphate) structure. The percentage of phosphorus atoms in the pyrophosphate structure may be 30 to 100 mole %, or 40 to 90% or 50 to 80% or 55 to 70% or 55 to 65%. The remaining amount of the phosphorus atoms may be in an orthophosphate structure or may consist, in part, in unreacted phosphorus acid or other phosphorus species. In one embodiment, up to 60 or up to 50 mole percent of the phosphorus atoms are in mono- or di-alkyl-orthophosphate salt structure.

The substantially sulfur-free alkyl phosphate amine salt, as present in the pyrophosphate form (sometimes referred to as the POP structure), may be represented in part by the following formulas (I) and/or (II):

(V)

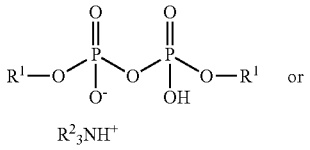

(VI)

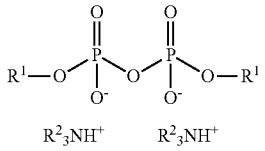

Formula (V) represents a half-neutralized phosphorus salt; formula (VI) a fully neutralized salt. It is believed that both of the two hydroxy hydrogen atoms of the first-formed phosphate structure are sufficiently acidic to be neutralized by an amine, so that formula (VI) may predominate if a stoichiometrically sufficient amount of amine is present. The extent of neutralization in practice, that is, the degree of salting of the —OH groups of the phosphorus esters, may be 50% to 100%, or 80% to 99%, or 90% to 98%, or 93% to 97%, or about 95%, which may be determined or calculated on the basis of the amount of amine charged to the phosphate ester mixture. Variants of these materials may also be present, such as a variant of formula (V) or formula (VI) wherein the —OH group (in (V) is replaced by another —$OR^1$ group or wherein one or more —$OR^1$ groups are replaced by —OH groups, or wherein an $R^1$ group is replaced by a phosphorus-containing group, that is, those comprising a third phosphorus structure in place of a terminal $R^1$ group. Illustrative variant structures may include the following:

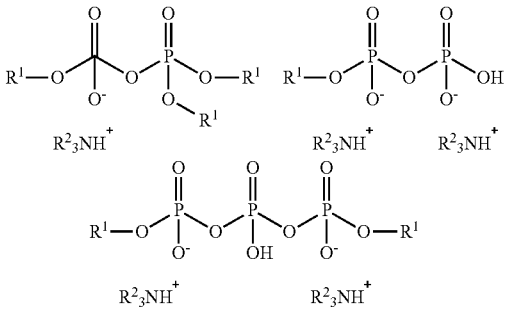

The structures of formulas (V) and (VI) are shown as entirely sulfur-free species, in that the phosphorus atoms are bonded to oxygen, rather than sulfur atoms. However, it is possible that a small molar fraction of the O atoms could be replaced by S atoms, such as 0 to 5 percent or 0.1 to 4 percent or 0.2 to 3 percent or 0.5 to 2 percent.

These pyrophosphate salts may be distinguished from orthophosphate salts of the general structure:

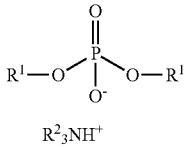

which optionally may also be present in amounts as indicated above.

In formulas (V) and (VI), each $R^1$ is independently an alkyl group of 3 to 12 carbon atoms. In certain embodiments at least 80 mole percent, or at least 85, 90, 95, or 99 percent, of the alkyl groups will be secondary alkyl groups. In some embodiments the alkyl groups will have 4 to 12 carbon atoms, or 5 to 10, or 6 to 8 carbon atoms. Such groups include 2-butyl, 2-pentyl, 3-pentyl, 3-methyl-2-butyl, 2-hexyl, 3-hexyl, cyclohexyl, 4-methyl-2-pentyl, and other such secondary groups and isomers thereof having 6, 7, 8, 9, 10, 11, or 12 carbon atoms. In some embodiments the alkyl group will have a methyl branch at the α-position of the group, an example being the 4-methyl-2-pentyl (also referred to as 4-methylpent-2-yl) group.

Such alkyl (including cycloalkyl) groups will typically be provided by the reaction of the corresponding alcohol or alcohols with phosphorus pentoxide (taken herein to be $P_2O_5$ although it is recognized the more probable structure may be represented by $P_4O_{10}$). Typically, 2 to 3.1 moles of alcohol will be provided per mole of $P_2O_5$ to provide a mixture of partial esters including mono- and diesters of the orthophosphate structure and diesters of the pyrophosphate structure:

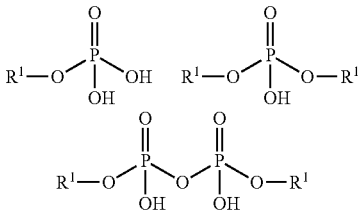

In certain embodiments 2.5 to 3 moles of alcohol may be provided per mole of $P_2O_5$, or 2.2 to 2.8 moles/mole, or even 2.2 to 2.4 moles/mole. The 2.5 to 3 (or 2.2-2.8 or 2.2-2.4) moles of alcohol typically may be made available to react with the $P_2O_5$ (i.e., included in the reaction mixture) but normally the actual reaction will consume less than 3 moles/mole. Thus, the alkyl phosphate amine salt may be prepared by the reaction of phosphorus pentoxide with a secondary alcohol having 4 to 12 carbon atoms, and reacting the product thereof with an amine, as described in further detail below.

Reaction conditions and reactants may be selected which will favor formation of the esters of the pyrophosphate structure and will relatively disfavor formation of the orthophosphate mono- and di-esters. The use of secondary alcohols, rather than primary alcohols, is found to favor formation of the pyrophosphate structure. Favorable synthesis temperatures include 30 to 60° C. or 35 to 50° C. or 40 to 50° C. or 30 to 40° C., or about 35° C., and in some embodiments the temperature of reaction may be 50-60° C.

Subsequent heating at 60 to 80° C. or about 70 ° C. after the initial mixing of components may be desirable. It may be desirable to avoid over-heating the reaction mixture or to discontinue heating once the reaction is substantially complete, particularly if the temperature is 60° C. or above; this will be apparent to the person skilled in the art. In certain embodiments the reaction temperature will not exceed 62° C. or 61° C. or 60° C. Favorable conditions may also include exclusion of extraneous water. The progress of the reaction and the relative amounts of the various phosphorus species may be determined by spectroscopic means known to those skilled in the art, including infrared spectroscopy and $^{31}P$ or $^{1}H$ NMR spectroscopy.

While the pyrophosphate ester may be isolated, if desired, from the orthoesters, it is also possible, and may be commercially preferable, to use the reaction mixture without separation of the components.

The pyrophosphate phosphate ester or mixture of phosphate esters with be reacted with an amine to form an amine salt. The amine may be represented by $R^2{}_3N$, where each $R^2$ is independently hydrogen or a hydrocarbyl group or an ester-containing group, or an ether-containing group, provided that at least one $R^2$ group is a hydrocarbyl group or an ester-containing group or an ether-containing group (that is, not $NH_3$). Suitable hydrocarbyl amines include primary amines having 1 to 18 carbon atoms, or 3 to 12, or 4 to 10 carbon atoms, such as methylamine, ethylamine, propylamine, isopropylamine, butylamine and isomers thereof, pentylamine and isomers thereof, hexylamine and isomers thereof, heptylamine and isomers thereof, octylamine and isomers thereof such as isooctylamine and 2-ethylhexylamine, as well as higher amines. Other primary amines include dodecylamine, fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen® C, Armeen® 0, Armeen® OL, Armeen® T, Armeen® HT, Armeen® S and Armeen® SD, wherein the letter designation relates to the fatty group, such as coco, oleyl, tallow, or stearyl groups.

Secondary amines that may be used include dimethylamine, diethylamine, dipropylamine, dibutylamine, diamylamine, dihexylamine, diheptylamine, methylethyl-amine, ethylbutylamine, bis-2-ethylhexylamine, N-methyl-1-aminocyclohexane, Armeen® 2C, and ethylamylamine. The secondary amines may be cyclic amines such as piperidine, piperazine and morpholine.

Suitable tertiary amines include tri-n-butylamine, tri-n-octylamine, tri-decylamine, tri-laurylamine, tri-hexadecylamine, and dimethyloleylamine (Armeen® DMOD). Triisodecylamine or tridecylamine and isomers thereof may be used.

Examples of mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine. In one embodiment a useful mixture of amines includes "Primene® 81R" or "Primene® JMT." Primene® 81R and Primene® JMT (both produced and sold by Rohm & Haas) may be mixtures of Cu to $C_{14}$ tertiary alkyl primary amines and $C_{18}$ to $C_{22}$ tertiary alkyl primary amines, respectively In other embodiments the amine may be an ester-containing amine such as an N-hydrocarbyl-substituted γ- or δ-amino(thio)ester, which is therefore a secondary amine. One or both of the O atoms of the ester group may be replaced by sulfur, although typically there may be no sulfur atoms. An N-substituted γ-aminoester may be represented by

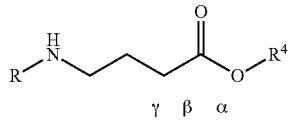

and an N-substituted δ-aminoester may be represented by

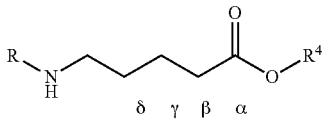

There may also be one or more additional substituents or groups at the α, β, γ, or δ positions of the aminoester. In one embodiment there are no such substituents. In another embodiment there is a substituent at the β position, thus leading to a group of materials represented, in certain embodiments, by the formula

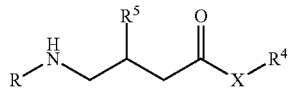

R and $R^4$are as defined below; X is O or S (in one embodiment, O) and $R^5$ may be hydrogen, a hydrocarbyl group, or a group represented by —C(═O)—$R^6$ where $R^6$ is hydrogen, an alkyl group, or —X'—$R^7$, where X' is O or S and $R^7$ is a hydrocarbyl group of 1 to 30 carbon atoms. That is, a substituent at the β position of the chain may comprise an ester, thioester, carbonyl, or hydrocarbyl group. When $R^5$ is —C(═O)—$R^6$, the structure may be represented by

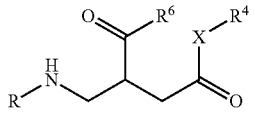

The analogous structures for a δ-amino ester will be understood to be encompassed; this may be, e.g.,

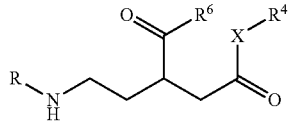

It will be evident that when $R^6$ is —X'—$R^7$ the materials will be substituted succinic acid esters or thioesters. In particular, in one embodiment the material may be a methyl succinic acid diester, with amine substitution on the methyl group. The $R^4$ and $R^7$ groups may be the same or different; in certain embodiments they may independently have 1 to 30 or 1 to 18 carbon atoms, as described below for $R^4$. In certain embodiments, the material may be represented by the structure

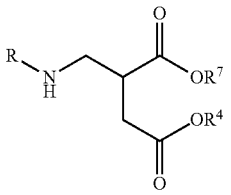

In certain embodiments, the material will be or will comprise a 2-((hydrocarbyl)-aminomethyl succinic acid dihydrocarbyl ester (which may also be referred to as a dihydrocarbyl 2-((hydrocarbyl)aminomethyl succinate).

In the above structures, The hydrocarbyl substituent R on the amine nitrogen may comprise a hydrocarbyl group of at least 3 carbon atoms with a branch at the 1 or 2 (that is, αor β) position of the hydrocarbyl chain (not to be confused with the α or β location of the ester group, above). Such a branched hydrocarbyl group R may be represented by the partial formula

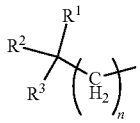

where the bond on the right represents the point of attachment to the nitrogen atom. In this partial structure, n is 0 or 1, $R^1$ is hydrogen or a hydrocarbyl group, $R^2$ and $R^3$ may independently be hydrocarbyl groups or together may form a carboxylic structure. The hydrocarbyl groups may be aliphatic, cycloaliphatic, or aromatic, or mixtures thereof. When n is 0, the branching is at the 1 or α position of the group. When n is 1, the branching is at the 2 or β position. If $R^4$, above, is methyl, then n may in some embodiments be 0.

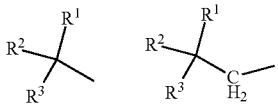

1- or α branching 2- or β branching

There may, of course, be branching both at the 1 position and the 2 position. Attachment to a cyclic structure is to be considered branching:

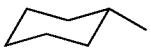

(a type of 1- or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

In the above structures, $R^4$, the alcohol residue portion, may have 1 to 30 or 1 to 18 or 1 to 12 or 2 to 8 carbon atoms. It may be a hydrocarbyl group or a hydrocarbon group. It may be aliphatic, cycloaliphatic, branched aliphatic, or aromatic. In certain embodiments, the $R^4$group may methyl, ethyl, propyl, isopropyl, n-butyl, iso-butyl, t-butyl, n-hexyl, cyclohexyl, iso-octyl, or 2-ethylhexyl. If $R^4$is methyl, then the R group, the hydrocarbyl substituent on the nitrogen, may often have a branch at the 1-position. In other embodiments the $R^4$ group may be an ether-containing group. For instance, it may be an ether-containing group or a polyether-containing group which may contain, for instance 2 to 120 carbon atoms along with oxygen atoms representing the ether functionality.

In another embodiment, $R^4$ can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified alkyl group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester or a thioester. In one embodiment, one or more of the hydroxy groups within $R^4$ may be condensed with or attached to an additional group so as to from a bridged species.

In one embodiment, the amine may be represented by the structure

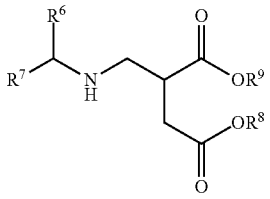

wherein $R^6$ and $R^7$ are independently alkyl groups of 1 to about 6 carbon atoms and $R^8$ and $R^9$ are independently alkyl groups of 1 to about 12 carbon atoms.

The N-hydrocarbyl-substituted γ-aminoester or γ-aminothioester materials disclosed herein may be prepared by a Michael addition of a primary amine, typically having a branched hydrocarbyl group as described above, with an ethylenically unsaturated ester or thio ester of the type described above. The ethylenic unsaturation, in this instance, would be between the β and γ carbon atoms of the ester. Thus, the reaction may occur, for example, as

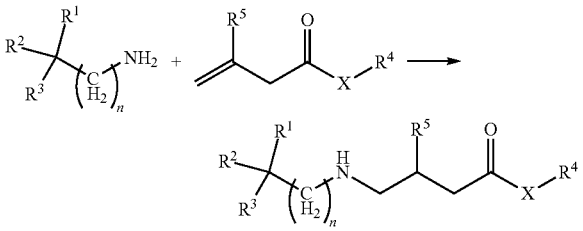

where the X and R groups are as defined above. In one embodiment the ethylenically unsaturated ester may be an ester of itaconic acid. In this structure n may be 0 or 1, $R^1$ may be hydrogen or a hydrocarbyl group, $R^2$ and $R^3$ may independently be hydrocarbyl groups or together form a carbocyclic structure, X is O or S, $R^4$ may be a hydrocarbyl group of 1 to 30 carbon atoms, and $R^5$ may be hydrogen, a hydrocarbyl group, or a group represented by —C(=O)—$R^6$ where $R^6$ is hydrogen, an alkyl group, or —X'—$R^7$, where X' is O or S and $R^7$ is a hydrocarbyl group of 1 to 30 carbon atoms. In one embodiment, the amine reactant is not a tertiary hydrocarbyl (e.g., t-alkyl) primary amine, that is, n is not zero while $R^1$, $R^2$, and $R^3$ are each hydrocarbyl groups.

The amine that may reacting to form the above Michael addition product may be a primary amine, so that the resulting product will be a secondary amine, having a branched R substituent as described above and the nitrogen also being attached to the remainder of the molecule.

The N-hydrocarbyl-substituted δ-aminoester or δ-aminothioester materials disclosed herein may be prepared by reductive amination of the esters of 5-oxy substituted carboxylic acids or 5-oxy substituted thiocarboxylic acids. They may also be prepared by amination of the esters of 5-halogen substituted carboxylic acids or 5-halogen substituted thiocarboxylic acids, or by reductive amination of the esters of 2-amino substituted hexanedioc acids, or by alkylation of the esters of 2-aminohexanedioic acids.

Further detailed description of the N-substituted γ-amino ester and details of its synthesis may be found in WO2014/074335, Lubrizol, May 15, 2014. Further detailed description of the N-substituted δ-amino ester and details of its synthesis may be found in PCT application PCT/US2015/027958, Lubrizol, filed Apr. 28, 2015 and U.S. 61/989306, filed May 6, 2015.

The amine, of whatever type, will be reacted to neutralize the acidic group(s) on the phosphorus ester component, which will comprise the pyrophosphate ester as described above as well as any orthophosphate esters that may be present.

In one embodiment, the ashless phosphorus-containing antiwear agent is an alkyl phosphate amine salt. Amine phosphate salts may be derived from mono- or di-hydrocarbyl phosphoric acid (typically alkyl phosphoric acid), or mixtures thereof. The alkyl of the mono- or di-hydrocarbyl phosphoric acid may comprise linear or branched alkyl groups of 3 to 36 carbon atoms. The hydrocarbyl group of the linear or branched hydrocarbylphosphoric acid may contain 4 to 30, or 8 to 20 carbon atoms. Examples of a suitable hydrocarbyl group of the hydrocarbyl phosphoric acid may include isopropyl, n-butyl, sec-butyl, amyl, 4-methyl-2-pentyl (i.e. methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the phosphate is a mixture of mono- and di-(2-ethylhexyl)phosphate.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as coco, oleyl, tallow, or stearyl groups.

The compositions disclosed herein may include an amine dialkyldithiophosphate. Examples of suitable amine (or ammonium) dialkyldithiophosphate include salts of Formula:

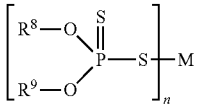

wherein $R^8$ and $R^9$ are independently hydrocarbyl groups containing 3 to 30 or to 20, to 16, or to 14 carbon atoms are readily obtainable by the reaction of phosphorus pentasulfide ($P_2S_5$) and an alcohol or phenol to form an O,O-dihydrocarbyl phosphorodithioic acid corresponding to Formula:

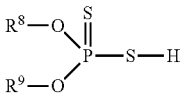

The reaction involves mixing at a temperature of 20° C. to 200° C., four moles of an alcohol or a phenol with one mole of phosphorus pentasulfide. Hydrogen sulfide is liberated in this reaction. The acid is then reacted with a basic amine (or ammonium) compound to form the salt.

In some embodiments, the $R^8$ and $R^9$ groups here are independently hydrocarbyl groups and are typically free from acetylenic and usually also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and 2-propanol or, alternatively, a mixture of secondary alcohols such as 2-propanol and 4-methyl-2-pentanol.

In certain embodiments, the dialkyldithiophosphate may have $R^8$ and $R^9$ groups selected to reduce phosphorus volatility from the lubricant, that is, to increase retention of phosphorus in the lubricant. Suitable formulations to provide good phosphorus retention in an engine are disclosed, for instance, in US published application 2008-0015129, see, e.g., claims.

Such amine salts are often referred to as amine dialkyldithiophosphates or simply amine dithiophosphates. They are well known and readily available to those skilled in the art of lubricant formulation. Further amine dialkyldithiophosphates may be described as primary dialkyldithiophosphates or as secondary dialkyldithiophosphates, depending on the structure of the alcohol used in its preparation. In some embodiments the compositions of the invention include primary dialkyldithiophosphates. In some embodiments the compositions of the invention include secondary dialkyldithiophosphates. In some embodiments the compositions of the invention include a mixture of primary and secondary dialkyldithiophosphates. In some embodiments, the amine salt is a mixture of primary and secondary dialkyldithiophosphates where the ratio of primary dialkyldithiophosphates to secondary dialkyldithiophosphates (one a weight basis) is at least 1:1, or even at least 1:1.2, or even at least 1:1.5 or 1:2, or 1:10. In some embodiments the amine phosphate is a mixture of primary and secondary dialkyldithiophosphates that is at least 50 percent by weight primary, or even at least 60, 70, 80, or even 90 percent by weight primary.

In one embodiment, alkyl phosphate amine salt is an alkyldithiophosphate amine salt. Dialkyldithiophosphates are known in the art. Amine dithiophosphates may comprise linear or branched alkyl groups containing from 3 to 20 carbon atoms, or 3 to 12 carbon atoms, or 4 to 8 carbon atoms.

Examples of dithiophosphates that may be amine salted include isopropyl methylamyl dithiophosphate, isopropyl isooctyl dithiophosphate, di(cyclohexyl) dithiophosphate, isobutyl 2-ethylhexyl dithiophosphate, isopropyl 2-ethylhexyl dithiophosphate, isobutyl isoamyl dithiophosphate, isopropyl n-butyl dithiophosphate, and combinations thereof.

The ashless phosphorus-containing antiwear may be present in the lubricating composition in an amount of from 0.1 to 1.5 wt %. In other embodiments, the ashless phosphorus-containing antiwear is present in the lubricating composition in an amount of from 0.3 to 1.2 wt %. In yet another embodiment, the ashless phosphorus-containing antiwear is present in the lubricating composition in an amount of from 0.5 to 1.1 wt %. In another embodiment, the ashless phosphorus-containing antiwear is present in the lubricating composition in an amount of from 0.6 to 0.9 wt %.

In certain embodiments, the amount of ashless phosphorus-containing antiwear agent is defined by the amount of phosphorus it can deliver to the lubricating composition. In such embodiments, the ashless phosphorus-containing antiwear is present in amount to deliver from 500 to 900 ppm phosphorus to the lubricating composition. In another embodiment, the ashless phosphorus-containing antiwear is present in amount to deliver from 550 to 850 ppm phosphorus to the lubricating composition. In another embodiment, the ashless phosphorus-containing antiwear is present in amount to deliver from 600 to 825 ppm phosphorus to the lubricating composition. In another embodiment, the ashless phosphorus-containing antiwear is present in amount to deliver from 650 to 800 ppm phosphorus to the lubricating composition. In another embodiment, the ashless phosphorus-containing antiwear is present in amount to deliver from 700 to 800 ppm phosphorus to the lubricating composition.

Alkaline Earth Metal Detergent

The lubricating compositions disclosed herein further include an alkaline earth metal detergent. Suitable alkaline earth metal detergents include metal overbased detergents.

Metal overbased detergents, otherwise referred to as overbased detergents, metal-containing overbased detergents or superbased salts, are characterized by a metal content in excess of that which would be necessary for neutralization according to the stoichiometry of the metal and the particular acidic organic compound, i.e. the substrate, reacted with the metal. The overbased detergent may comprise one or more of non-sulfur containing phenates, sulfur containing phenates, sulfonates, salicylates, and mixtures thereof.

The amount of excess metal is commonly expressed in terms of substrate to metal ratio. The terminology "metal ratio" is used in the prior art and herein to define the ratio of the total chemical equivalents of the metal in the overbased salt to the chemical equivalents of the metal in the salt which would be expected to result from the reaction between the hydrocarbyl substituted organic acid; the hydrocarbyl-substituted phenol or mixtures thereof to be overbased, and the basic metal compound according to the known chemical reactivity and the stoichiometry of the two reactants. Thus, in a normal or neutral salt (i.e. soap) the metal ratio is one and, in an overbased salt, the metal ratio is greater than one, especially greater than 1.3. The overbased detergent of the invention may have a metal ratio of 5 to 30, or a metal ratio of 7 to 22, or a metal ratio of at least 11.

The metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. Overbased phenates and salicylates typically have a total base number of 180 to 450 TBN. Overbased sulfonates typically have a total base number of 250 to 600, or 300 to 500. Overbased detergents are known in the art.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substitued hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) p-dodecylphenol. In one embodiment, the lubricating composition of the invention contains less than 0.3 weight percent of alkylphenol, less than 0.1 weight percent of alkylphenol, or less than 0.05 weight percent of alkylphenol.

The overbased metal-containing detergent may be alkali metal or alkaline earth metal salts. In one embodiment, the overbased detergent may be sodium salts, calcium salts, magnesium salts, or mixtures thereof of the phenates, sulfur-containing phenates, sulfonates, salixarates and salicylates. In one embodiment, the overbased detergent is a calcium detergent, a magnesium detergent or mixtures thereof. In one embodiment, the overbased calcium detergent may be present in an amount to deliver at least 500 ppm calcium by weight and no more than 3000 ppm calcium by weight, or at least 1000 ppm calcium by weight, or at least 2000 ppm calcium by weight, or no more than 2500 ppm calcium by weight to the lubricating composition. In one embodiment, the overbased detergent may be present in an amount to deliver no more than 500 ppm by weight of magnesium to the lubricating composition, or no more than 330 ppm by weight, or no more than 125 ppm by weight, or no more than 45 ppm by weight. In one embodiment, the lubricating composition is essentially free of (i.e. contains less than 10 ppm) magnesium resulting from the overbased detergent. In one embodiment, the overbased detergent may be present in an amount to deliver at least 200 ppm by weight of magnesium, or at least 450 ppm by weight magnesium, or at least 700 ppm by weight magnesium to the lubricating composition. In one embodiment, both calcium and magnesium containing detergents may be present in the lubricating composition. Calcium and magnesium detergents may be present such that the weight ratio of calcium to magnesium is 10:1 to 1:10, or 8:3 to 4:5, or 1:1 to 1:3. In one embodiment, the overbased detergent is free of or substantially free of sodium.

In one embodiment, the sulfonate detergent may be predominantly a linear alkylbenzene sulfonate detergent having a metal ratio of at least 8 as is described in paragraphs to of US Patent Publication 2005/065045 (and granted as U.S. Pat. No. 7,407,919). The linear alkylbenzene sulfonate detergent may be particularly useful for assisting in improving fuel economy. The linear alkyl group may be attached to the benzene ring anywhere along the linear chain of the alkyl group, but often in the 2, 3 or 4 position of the linear chain, and in some instances, predominantly in the 2 position, resulting in the linear alkylbenzene sulfonate detergent.

Salicylate detergents and overbased salicylate detergents may be prepared in at least two different manners. Carbonylation (also referred to as carboxylation) of a p-alkylphenol is described in many references including U.S. Pat. No.8,399,388. Carbonylation may be followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing, as described in U.S. Pat. No.7,009,072. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms. In one embodiment, the overbased detergent of the invention is a salicylate detergent. In one embodiment, the salicylate detergent of the invention is free of unreacted p-alkylphenol (i.e., contains less than 0.1 weight percent). In one embodiment, the salicylate detergent of the invention is prepared by alkylation of salicylic acid.

In some embodiments, the metal of the alkaline earth metal detergent is selected from calcium, magnesium, or mixtures thereof. In one embodiment, the alkaline earth metal detergent is a calcium sulfonate detergent. In another embodiment, the alkaline earth metal detergent is a magnesium sulfonate detergent. In one embodiment, the alkaline earth metal detergent is a mixture of two or more alkaline earth metal detergents. In embodiments where the alkaline earth metal detergent is a mixture, the mixture may include a calcium sulfonate detergent and a magnesium sulfonate detergent.

The alkaline earth metal detergent may be present in the lubricating composition in an amount of from 0.3 to 2.5 wt % based on the total weight of the lubricating composition. In one embodiment, the alkaline earth metal detergent may be present in the lubricating composition in an amount of from 0.5 to 2.0 wt % based on the total weight of the lubricating composition. In another embodiment, the alkaline earth metal detergent may be present in the lubricating composition in an amount of from 0.6 to 1.8 wt % based on the total weight of the lubricating composition. In embodiments having a mixture of alkaline earth metal detergents, on detergent may be present in the lubricating composition in an amount of from 0.4 to 0.8 wt % and a second detergent may be present in an amount of from 0.6 to 1.1 wt %. The total amount of alkaline earth metal detergent mixture in the lubricating composition may be from about 0.8 to 2.0 wt %. In one embodiment, the alkaline earth metal detergent includes a calcium sulfonate detergent present in the lubricating composition in an amount of from 0.4 to 0.8 wt % and a magnesium sulfonate detergent present in the lubricating composition in an amount of from 0.6 to 1.1 wt % based on the total weight of the lubricating composition.

Ashless Antioxidant

The lubricating compositions disclosed herein further include an ashless antioxidant. Ashless antioxidants include arylamines, diarylamines, alkylated arylamines, alkylated diarylamines, phenols, hindered phenols, sulfurized olefins, and mixtures thereof.

Suitable arylamines include secondary or tertiary amines substituted by a single, optionally substituted, aryl group attached to the amine nitrogen. An example of an arylamine includes N-alkyl naphthylamine which may have one or two N-alkyl groups, i.e., the nitrogen group is mono- or di-substituted. In one embodiment, the nitrogen group is primarily mono-substituted. The N-alkyl group(s) may be acyclic, cyclic, or alicyclic. Acyclic alkyl groups may be branched.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment, the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

Diarylamines of the invention may also be represented by the following formula:

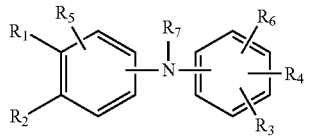

wherein $R_1$ and $R_2$ are moieties which, together with the carbon atoms to which they are bonded, are joined together to form a 5-, 6-, or 7-membered ring (such as a carbocyclic ring or cyclic hydrocarbylene ring); $R_3$ and $R_4$ are independently hydrogen, hydrocarbyl groups, or are moieties which, taken together with the carbon atoms to which they are bonded, form a 5-, 6-, or 7-membered ring (such as a carbocyclic ring or cyclic hydrocarbylene ring); $R_5$ and $R_6$ are independently hydrogen, hydrocarbyl groups, or are moieties (typically hydrocarbyl moieties) which, taken together with the carbon atoms to which they are attached, form a ring, or represent a zero-carbon or direct linkage between the rings; and $R_7$ is hydrogen or a hydrocarbyl group.

In one embodiment, the diarylamine is a N-phenyl-naphthylamine (PNA).

In another embodiment, the diarylamine may be represented by formula:

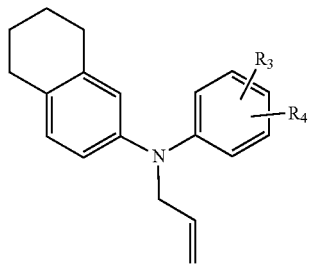

wherein $R_3$ and $R_4$ are defined as above.

In another embodiment, the diarylamine compounds include those having the general formula:

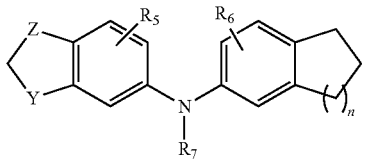

wherein $R_7$ is defined as above; $R_5$ and $R_6$ are independently hydrogen, hydrocarbyl groups or taken together may form a ring, such as a dihydroacridan; n=1 or 2; and Y and Z independently represent carbon or heteroatoms such as N, O and S.

In a particular embodiment, diarylamine compounds include those of formula:

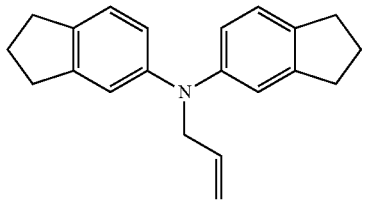

In one embodiment, the diarylamine is a dihydroacridan derivative of formula:

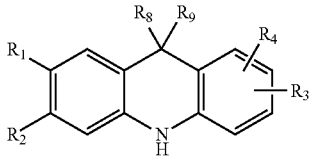

wherein $R_1$, $R_2$, $R_3$, and $R_4$ are defined above; $R_8$ and $R_9$ are independently hydrogen or a hydrocarbyl group of 1 to 20 carbon atoms.

In one embodiment, the diarylamine is chosen such that $R_5$ and $R_6$ represent a direct (or zero-carbon) link between the aryl rings. The result is a carbazole of formula:

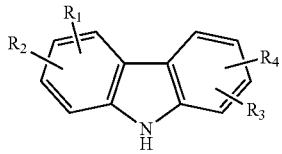

wherein $R_1$, $R_2$, $R_3$, and $R_4$ are defined as above.

The diarylamine antioxidant may be present in the lubricating composition lubrication composition at 0.1% to 10%, 0.35% to 5%, or even 0.5% to 2% wt %, or 0.1 to 2.1 wt % or 0.2 to 1.8 wt % based on the total weight of the lubricating composition.

The phenolic antioxidant may be a simple alkyl phenol, a hindered phenol, or coupled phenolic compounds.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, 4-dodecyl-2,6-di-tert-butylphenol, or butyl 3-(3,5-ditert-butyl-4-hydroxyphenyl)propanoate. In one embodiment, the hindered phenol antioxidant may be an ester and may include, e.g., Irganox™ L-135 from Ciba.

Coupled phenols often contain two alkylphenols coupled with alkylene groups to form bisphenol compounds. Examples of suitable coupled phenol compounds include 4,4'-methylene bis-(2,6-di-tert-butyl phenol), 4-methyl-2,6-di-tert-butylphenol, 2,2'-bis-(6-t-butyl-4-heptylphenol); 4,4'-bis(2,6-di-t-butyl phenol), 2,2'-methylenebis(4-methyl-6-t-butylphenol), and 2,2'-methylene bis(4-ethyl-6-t-butylphenol).

Phenols of the invention also include polyhydric aromatic compounds and their derivatives. Examples of suitable polyhydric aromatic compounds include esters and amides of gallic acid, 2,5-dihydroxybenzoic acid, 2,6-dihydroxybenzoic acid, 1,4-dihydroxy-2-naphthoic acid, 3,5-dihydroxynaphthoic acid, 3,7-dihydroxy naphthoic acid, and mixtures thereof.

In one embodiment, the phenolic antioxidant comprises a hindered phenol. In another embodiment the hindered phenol is derived from 2,6-ditertbutyl phenol.

In one embodiment, the lubricating composition of the disclosure includes a phenolic antioxidant in a range of 0.01 wt % to 5 wt %, or 0.1 wt % to 4 wt %, or 0.1 to 2.1 wt %, or 0.2 to 1.8 wt %, or 0.2 wt % to 3 wt %, or 0.5 wt % to 2 wt % of the lubricating composition.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. These materials generally have sulfide linkages having 1 to 10 sulfur atoms, for instance, 1 to 4, or 1 or 2.

The ashless antioxidants of the invention may be used separately or in combination. In one embodiment, two or more different antioxidants are used in combination, such that there is at least 0.1 weight percent of each of the at least two antioxidants and wherein the combined amount of the ashless antioxidants is 0.5 to 5 weight percent.

The ashless antioxidant may be present in an amount of from 0.1 to 2.1 wt %, or from 0.2 to 1.8 wt % based on the total weight of the lubricating composition.

In one embodiment, the ashless antioxidant is an alkylated diarylamine. In another embodiment, the ashless antioxidant is a sulfurized olefin. In yet another embodiment, the ashless antioxidant is a mixture of ashless antioxidants including from 0.8 to 1.3 wt % of an alkylated diarylamine and from 0.1 to 0.5 wt % of a sulfurized olefin.

Ashless Dispersant

The lubricating composition disclosed herein further includes an ashless dispersant. The dispersant may be a succinimide dispersant, a Mannich dispersant, a polyolefin succinic acid ester, amide, or ester-amide, or mixtures thereof. In one embodiment, the dispersant may be a succinimide dispersant. In another embodiment, the dispersant is a borated succinimide dispersant. In one embodiment, the dispersant may be present as a single dispersant. In another embodiment, the dispersant may be present as a mixture of two or three different dispersants.

The succinimide dispersant may be a derivative of an aliphatic polyamine, or mixtures thereof. The aliphatic polyamine may be aliphatic polyamine such as an ethylenepolyamine, a propylenepolyamine, a butylenepolyamine, or mixtures thereof. In one embodiment, the aliphatic polyamine may be ethylenepolyamine. In one embodiment, the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from $C_2$-$C_6$ epoxides such as ethylene oxide, propylene oxide, and butylene oxide. Examples of polyether polyamines are sold under the Jeffamine® brand and are commercially available from Huntsman Corporation.

The dispersant may be a N-substituted long chain alkenyl succinimide. Examples of N-substituted long chain alkenyl succinimide include polyisobutylene succinimide. Typically, the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent 0 355 895B1.

The dispersant may also be post-treated by conventional methods by a reaction with any of a variety of agents. Among these are boron compounds, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be borated using one or more of a variety of agents selected from the group consisting of the various forms of boric acid (including metaboric acid, $HBO_2$, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents. Methods of preparing borated dispersants are known in the art. The borated dispersant may be prepared in such a way that they contain 0.1weight % to 2.5 weight % boron, or 0.1 weight % to 2.0 weight % boron or 0.2 to 1.5 weight % boron or 0.3 to 1.0 weight % boron.

Suitable polyisobutylenes for use in the succinimide dispersant may include those formed from polyisobutylene or highly reactive polyisobutylene having at least about 50 mol %, such as about 60 mol %, and particularly from about 70 mol % to about 90 mol % or greater than 90 mol %, terminal vinylidene content. Suitable polyisobutenes may include those prepared using $BF_3$ catalysts. In one embodiment, the borated dispersant is derived from a polyolefin having number average molecular weight of 350 to 3000 Daltons and a vinylidene content of at least 50 mol %, or at least 70 mol %, or at least 90 mol %.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B.C. Trivedi and B.C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200 ° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may be used alone or as part of a mixture of non-borated and borated dispersants. If a mixture of dispersants is used, there may be two to five, or two to three or two dispersants.

The polyolefin dispersant may comprise a polyalphaolefins (PAO) containing dispersant selected from the group consisting of a polyalphaolefin succinimide, a polyalphaolefin succinamide, a polyalphaolefin acid ester, a polyalphaolefin oxazoline, a polyalphaolefin imidazoline, a polyalphaolefin succinamide imidazoline, and combinations thereof.

Polyalphaolefins (PAO) useful as feedstock in forming the PAO containing dispersants are those derived from oligomerization or polymerization of ethylene, propylene, and α-olefins. Suitable α-olefins include 1-butene, 1-pentene, 1-hexene, 1-heptene, 1-octene, 1-nonene, 1-decene, 1-undecene, 1-dodecene, 1-tetradecene, and 1-octadecene. Feedstocks containing a mixture of two or more of the foregoing monomers as well as other hydrocarbons are typically employed when manufacturing PAOs commercially. The PAO may take the form of dimers, trimers, tetramers, polymers, and the like.

The PAO may be reacted with maleic anhydride (MA) to form the polyalphaolefin succinic anhydride (PAO-SA) and subsequently the anhydride may be reacted with one or more of polyamines, aminoalcohols, and alcohols/polyols to form polyalphaolefin succinimide, polyalphaolefin succinamide, polyalphaolefin succinic acid ester, polyalphaolefin oxazoline, polyalphaolefin imidazoline, polyalphaolefin-succinamide-imidazoline, and mixtures thereof.

Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515.

A useful nitrogen containing dispersant includes the product of a Mannich reaction between (a) an aldehyde, (b) a polyamine, and (c) an optionally substituted phenol. The phenol may be substituted such that the Mannich product has a molecular weight of less than 7500. Optionally, the molecular weight may be less than 2000, less than 1500, less than 1300, or for example, less than 1200, less than 1 100, less than 1000. In some embodiments, the Mannich product has a molecular weight of less than 900, less than 850, or less than 800, less than 500, or less than 400. The substituted phenol may be substituted with up to 4 groups on the aromatic ring. For example, it may be a tri or di-substituted phenol. In some embodiments, the phenol may be a mono-substituted phenol. The substitution may be at the ortho, and/or meta, and/or para position(s). To form the Mannich product, the molar ratio of the aldehyde to amine is from 4:1 to 1:1 or, from 2:1 to 1:1. The molar ratio of the aldehyde to phenol may be at least 0.75:1; preferably from 0.75 to 1 to 4:1, preferably 1:1 to 4; 1 more preferably from 1:1 to 2:1. To form the preferred Mannich product, the molar ratio of the phenol to amine is preferably at least 1.5:1, more preferably at least 1.6:1, more preferably at least 1.7:1, for example at least 1.8:1, preferably at least 1.9:1. The molar ratio of phenol to amine may be up to 5:1; for example it may be up to 4:1, or up to 3.5:1. Suitably it is up to 3.25:1, up to 3:1, up to 2.5:1, up to 2.3:1 or up to 2.1:1.

In one embodiment, the ashless dispersant is a polyisobutylene succinimide dispersant. In another embodiment, the ashless dispersant is a borated polyisobutylene succinimide dispersant. In one embodiment, the ashless dispersant is present in the lubricating composition in an amount of from 1 to 6 wt %, or 2 to 5 wt %, or 2.5 to 4.5 wt %. In one embodiment, the ashless dispersant includes a mixture of from 0.8 to 1.6 wt % of a boron-free polyisobutylene succinimide dispersant and from 1.8 to 3.1 wt % of a borated polyisobutylene dispersant. In another embodiment, one or more of the boron-free polyisobutylene succinimide dispersant and the borated polyisobutylene succinimide dispersant is produced from a direct alkylation process.

The lubricating compositions disclosed herein are substantially free of zinc. When used herein "substantially free" means that the lubricating compositions may contain a minor amount of recited component as a non-functional addition. In some embodiments, the lubricating compositions may contain less than 50 ppm, or less than 40 ppm, or less than 30 ppm, or less than 20 ppm, or less than 10 ppm, or less than 5 ppm zinc. In one embodiment, the lubricating composition is free of zinc meaning that the lubricating composition contains 0 ppm zinc.

Other Additives

The lubricating compositions of the instant disclosure may optionally comprise one or more additional performance additives. These additional performance additives may include one or more metal deactivators, viscosity modifiers, friction modifiers, corrosion inhibitors, dispersant viscosity modifiers, extreme pressure agents, foam inhibitors, demulsifiers, pour point depressants, seal swelling agents, and any combination or mixture thereof. Typically, fully-formulated lubricating oil will contain one or more of these performance additives, and often a package of multiple performance additives.

Suitable dispersant viscosity modifiers include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment, the dispersant viscosity modifier may include those described in U.S. Pat. No. 4,863,623 (see column 2, line 15 to column 3, line 52) or in International Publication WO2006/015130 (see page 2, paragraph and preparative examples are described at paragraphs to [0073]).

In one embodiment, the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm, or 5 ppm to 300 ppm, or 20 ppm to 250 ppm of molybdenum.

In one embodiment, the invention provides a lubricating composition further comprising a friction modifier. Examples of friction modifiers include long chain fatty acid derivatives of amines, fatty esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides. The term fatty, as used herein, can mean having a C8-22 linear alkyl group.

Friction modifiers may also encompass materials such as sulfurized fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

In one embodiment, the friction modifier may be a long chain fatty acid ester. In another embodiment the long chain fatty acid ester may be a mono-ester or a diester or a mixture thereof, and in another embodiment, the long chain fatty acid ester may be a triglyceride.

Other performance additives such as corrosion inhibitors include those described in paragraphs 5 to 8 of U.S. application Ser. No. 05/038319, published as WO2006/047486, octyl octanamide, condensation products of dodecenyl succinic acid or anhydride and a fatty acid such as oleic acid with a polyamine. In one embodiment, the corrosion inhibitors include the Synalox® (a registered trademark of The Dow Chemical Company) corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

The lubricating composition may further include metal deactivators, including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and copolymers of ethyl acrylate and 2-ethylhexylacrylate and vinyl acetate; demulsifiers including trialkyl phosphates, polyethylene glycols, polyethylene oxides, polypropylene oxides and (ethylene oxide-propylene oxide) polymers; and pour point depressants, including esters of maleic anhydride-styrene, polymethacrylates, polyacrylates or polyacrylamides.

Pour point depressants that may be useful in the compositions of the invention further include polyalphaolefins, esters of maleic anhydride-styrene, poly(meth)acrylates, polyacrylates or polyacrylamides.

The lubricant composition for an internal combustion engine may be suitable for any engine lubricant irrespective of the sulfur, phosphorus or sulfated ash (ASTM D-874) content. The sulfur content of the engine oil lubricant may be 1.1 wt % or less, or 0.9 wt % or less, or 0.5 wt % or less, or 0.3 wt % or less. In one embodiment, the sulfur content may be in the range of 0.001 wt % to 0.5 wt %, or 0.01 wt % to 0.3 wt % or 0.5 to 1.0 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 900 ppm, or 300 to 875, or 400 to 850, or 600 to 800. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

In one embodiment, the lubricating composition may be an engine oil, wherein the lubricating composition may be characterized as having at least one of (i) a sulfur content of 0.5 wt % or less, (ii) a phosphorus content of 0.1 wt % or less, (iii) a sulfated ash content of 1.5 wt % or less, or combinations thereof.

The instant lubricating compositions may be used to reduce or eliminate Low Speed Preignition ("LSPI") in an engine. In one embodiment, lubricating compositions disclosed herein may be used in a method of reducing LSPI in a direct injection engine by supplying the lubricating composition to said engine. LSPI events may be catastrophic in nature. Hence drastic reduction or even elimination of LSPI events during normal or sustained operation of a direct fuel injection engine is desirable.

When operating a direct injection engine at speeds less than or equal to 3,000 rpm and under a load with a break mean effective pressure (BMEP) of greater than or equal to 10 bars, an LSPI even may occur. A LSPI event may consist of one or more LSPI combustion cycles, and generally consists of multiple LSPI combustion cycles which occur in a consecutive fashion or alternating fashion with normal combustion cycles in between. Without being bound to a particular theory, LSPI may result from a combustion of oil droplet(s), or a droplet(s) of oil-fuel mixture, or combinations thereof, which may accumulate, for example, in the top land crevices volume of a piston, or the piston ring-land and ring-groove crevices. The lubricant oil may be transferred from below the oil control ring to the piston top land area due to unusual piston ring movements. At low speed, high load conditions, in-cylinder pressures dynamics (compression and firing pressures) may be considerably different from in-cylinder pressures at lower loads, particularly due to strongly retarded combustion phasing and high boost and peak compression pressures which can influence ring motion dynamics.

At the foregoing loads, LSPI, which may be accompanied by subsequent detonation and/or severe engine knock, can cause severe damage to the engine very quickly (often within 1 to 5 engine cycles). Engine knock may occur with LSPI given that, after the normal spark from the igniter is provided, multiple flames may be present. The present invention aims to provide a method for inhibiting or reducing LSPI events, the method involving supplying to the engine a lubricant composition as disclosed herein.

Generally, the lubricant is added to the lubricating system of the internal combustion engine, which then delivers the lubricating composition to the critical parts of the engine, during its operation, that require lubrication. The engine components may have a surface of steel or aluminum (typically a surface of steel) and may also be coated for example with a diamondlike carbon (DLC) coating.

An aluminum surface may be comprised of an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may be fitted with an emission control system or a turbocharger. Examples of the emission control system include diesel particulate filters (DPF), or systems employing selective catalytic reduction (SCR).

The internal combustion engine of the present invention is distinct from a gas turbine. In an internal combustion engine, individual combustion events translate from a linear reciprocating force into a rotational torque through the rod and crankshaft. In contrast, in a gas turbine (which may also be referred to as a jet engine) a continuous combustion process generates a rotational torque continuously without translation and can also develop thrust at the exhaust outlet. These differences in operation conditions of a gas turbine and internal combustion engine result in different operating environments and stresses.

In one embodiment of the invention, the engine is operated at speeds between 500 rpm and 3000 rpm, or 800 rpm to 2800 rpm, or even 1000 rpm to 2600 rpm, or less than 3,000 rpm, or less than 2,500 rpm, or less than 2,000 rpm.

Additionally, the engine may be operated with a break mean effective pressure of 10 bars to 15 bars, or 10 to 20 bars, or 10 to 30 bars or 12 bars to 24 bars.

In one embodiment, the instant disclosure relates to a lubricant composition disclosed herein wherein the lubricant composition is capable of reducing low speed pre-ignition events in a spark-ignited direct injection internal combustion engine operated under a load with a brake mean effective pressure (BMEP) of greater than or equal to 10 bars at speeds less than or equal to 3,000 rpm.

In another embodiment, the instant disclosure relates to a method for reducing low speed preignition by supplying to a spark-ignited direct injection internal combustion engine a lubricant composition as disclosed herein. The method further includes supplying to a spark-ignited direct injection internal combustion engine operated under a load with a break mean effective pressure (BMEP) of greater than or equal to 10 bars and at speeds less than or equal to 3,000 rpm, any one of the lubricant compositions as disclosed herein.

In some embodiments, the engine may be fueled with a liquid hydrocarbon fuel, a liquid nonhydrocarbon fuel, or mixtures thereof.

The instant disclosure further relates to use of any one of the lubricant compositions disclosed herein to reduce low speed preignition in a spark-ignited direct injection internal combustion engine.

In different embodiments, the lubricating composition may have a composition as described in the following table.

Table of Embodiments

| Additive | Embodiments A | B | C |
|---|---|---|---|
| Ashless Phosphorus-Containing Antiwear agent | 0.1 to 3.0 | 0.25 to 2.5 | 0.35 to 1.7 |
| Alkaline Earth Metal Detergent | 0.2 to 5.0 | 0.35 to 2.3 | 0.45 to 1.3 |
| Ashless Dispersant | 0.5 to 8.6 | 0.8 to 5.4 | 1.6 to 3.8 |
| Ashless Antioxidant | 0.1 to 6.0 | 0.6 to 4.2 | 0.9 to 2.1 |
| Dispersant Viscosity Modifier | 0 to 5.0 | 0 to 2.6 | 0.1 to 1.8 |
| Friction Modifier | 0 to 1.5 | 0.05 to 1.2 | 0.2 to 0.75 |
| Viscosity Modifier | 0 to 8 | 0.2 to 4 | 0.5 to 2.1 |
| Any Other Performance Additive | 0 to 3 | 0.05 to 2 | 0.1 to 0.9 |
| Oil of Lubricating Viscosity | 75 to 98 | 82 to 95 | 87 to 93 |

EXAMPLES

The disclosure will be further illustrated by the following examples, which set forth particularly advantageous embodiments. While the examples are provided to illustrate the invention, they are not intended to limit it.

Ashless (i.e., metal-free) phosphorus compounds were evaluated for preventing and reducing wear as well as reducing low speed pre-ignition in low viscosity lubricating compositions. Several ashless compounds were prepared as detailed below, and several were obtained from commercial sources summarized below (Table 1).

Preparative Example A (EXA)

(Part i) 4-methyl-2-pentanol (1250 g) is charged to a 3 L reaction vessel equipped with a high shear mixer and a screw-feed powder addition funnel and heated to 60° C. Solid phosphorus pentoxide (752.5 g) is charged to the addition funnel and added over 1 hour and 45 minutes, with the high shear mixer operating at 6000 rpm. The reaction mixture is maintained at 60° C. for an additional 1.5 hours, after which the mixture is vacuum stripped for 30 minutes to provide the intermediate alkylphosphate acid (1958.5 g).

(Part ii) The alkylphosphate acid (12030 g) from Part (i) above (combined with earlier similar batches) is charged to a reaction vessel equipped with an overhead stirrer, theromocouple, and a nitrogen inlet and heated to 60° C. (2-ethylhexyl)amine (802.4 g) is added dropwise to the reaction vessel over 1.2 hours. Diluent oil (350 g) is added after approximately half of the amine addition was complete. The resulting orange liquid product is used without further purification (2352.3 g).

Preparative Example B (EXB)

(Part i) To a 5-L four-necked round-bottom flask equipped with a nitrogen subsurface inlet tube, thermocouple, mechanical glass rod stirrer, and a Friedrichs cold water condenser connected to a 25% sodium hydroxide trap and bleach trap is added 2-hydroxyethyl acrylate (97% purity, 797 g, 6.65 mol) which is warmed to 40° C. To this is added O,O'-di(4-methyl-2-pentyl)dithiophosphoric acid (2500 g, 6.86 mol, based on total acid number by analysis) dropwise over 2 hours (can be 1-2.5 hours) using a pressure equalized addition funnel, with temperature being between 55° C.-65° C. After the addition is complete, the reaction temperature is set to 65° C. (can be 65-70° C.) and the reaction stirred at this temperature for 7 hours (can be 3-5 hours or until the hydroxyethyl acrylate is consumed). The resulting intermediate is allowed to cool to ambient temperature to give a liquid (3297 g) and stored under an inert atmosphere (Part ii) To a 5-L four-necked round-bottom flask similarly equipped is added the intermediate from Part i (2872 g, 8.00 moles, based on amount of available OH groups, by analysis). Anhydrous sodium methoxide (1 g, 18.5 mmol) is added in one portion and the reaction is stirred for an additional 5 minutes. Dimethyl phosphite (449 g, 4.08 moles) is added in one portion and the reaction slowly heated to 95° C. while blowing nitrogen through the surface tube at about 28 L/hour (~1.0 sfch). The reaction mixture is held at 95° C. (may be 90-100° C.) for 8 hours with distillate being collected and removed via a Dean-Stark trap. The reaction mixture is stripped at 95° C. for 2 hours under reduced pressure (2.7 kPa, 20 mm Hg), providing additional distillate. 30 g of filter aid, dried overnight in an oven set at 90° C. is added to the flask and allowed to stir for an additional 15 minutes. 55 g of additional filter aid is used to pack a filter cake in a Büchner funnel under vacuum. The contents of the 5-L flask are then filtered through this cake and the resulting product is obtained as a pale yellowish brown clear liquid (2802 g; 9.5 wt % phosphorus).

Preparative Example C (EXC)

To a 2 L round bottom flask equipped with a Dean-Stark water-jacketed condenser, a mechanical stirrer, and a nitrogen inlet, dimethyl hydrogen phosphite (18.61 kg) is charged. 2-Ethyl-2-butyl-1,3-propanediol (37.1 kg) is melted in a steam chest and added to the phosphite in one portion. The reaction mixture is heated to 135° C., under nitrogen while stirring at 300 rpm. After distillation of methanol is complete (3.5 hours), 1,6-hexanediol (200 g) is added in one portion and the resulting mixture is stirred for an additional 2 hours. The resulting product mixture is vacuum stripped at 135° C. for 30 minutes to produce a clear, slightly yellow liquid (42.1 kg; 13.3 wt % phosphorus).

Preparative Example E (EXE)

To a 5 L round bottom flask equipped with a reflux condenser, a mechanical stirrer, and a nitrogen inlet, mixed amyl/isobutyl dialkyl dithiophosphoric acid (60:40 wt ratio of $C_4/C_5$ alkyl groups) (1700 g) is charged and heated to 62° C. Methylacrylate (196.4 g) was added slowly to maintain reaction temperature below 80° C. After addition of the acrylate was complete, the reaction mixture was heated to 98° C. and held there for 4 hours. After cooling the mixture to 40° C., propylene oxide (43.7 g) was added via subsurface tube. The reaction mixture was then heated to 80° C., vacuum stripped, and filtered through filter aid to produce a clear amber liquid (2020 g).

TABLE 1

Zinc-free Phosphorus Anti-wear agents

| | Chemistry Type | wt % P | wt % S | wt % N |
|---|---|---|---|---|
| EXA | Amine-salted pyrophosphate | 10 | 0 | 3.65 |
| EXB | Hydrogen phosphite coupled to a dithiophosphate ester | 9.5 | 13.2 | 0 |
| EXC | Diol-coupled hydrogen phosphite | 13.3 | 0.1 | 0 |
| EXD | Phosphonic acid, di-9-octadecen-1-yl ester | 5.25 | 0 | 0 |
| EXE | Neutral dithiophosphate ester | 9.0 | 18.0 | 0 |

A series of 0W-20 lubricating compositions were prepared containing the ashless phosphorus compounds of the invention, metal detergents, ashless dispersants, antioxidants, and other conventional additives, including polymeric viscosity index improvers, friction modifiers, corrosion inhibitors, pourpoint depressants, and foam inhibitors (Table 1).

Lubricating examples were evaluated for their ability to reduce or eliminate pre-ignition events in low speed engines operated at high break mean effective pressure (BMEP), as well as general lubricant performance such as wear reduction, antioxidancy, and cleanliness/deposit control (Table 3).

Low speed pre-ignition (LSPI) was evaluated in a Ford 2.0 L Ecoboost engine, a turbocharged gasoline direct injection (GDI) engine. The Ford Ecoboost engine is operated at 1750 rpm and 17.0 bar BMEP. The engine is operated at these conditions for a total of 175,000 combustion cycles and LSPI events are counted. The two stages are repeated four times and the number of pre-ignition events are reported as an average. Table 2 below shows the average LSPI events over the four runs. LSPI events are determined by monitoring peak cylinder pressure (PP) and mass fraction burn (MFB) of the fuel charge in the cylinder. When both criteria are met, it is determined that an LSPI event has occurred. The threshold for peak cylinder pressure is typically 9,000 to 10,000 kPa. The threshold for MFB is typically such that at least 2% of the fuel charge is burned late, i.e. before 5.5 degrees After Top Dead Center (ATDC).

Resistance to wear is evaluated in a high frequency, reciprocating rig (HFRR). The HFRR is available from PCS Instruments. Test conditions for the evaluations were steel ball on hardened steel disc, 200 g load, 60 minute duration, 20 Hertz frequency, and temperature was held constant at 120° C.

Resistance to oxidation and cleanliness are evaluated in a series of standard bench tests, including the Komatsu Hot Tube (KHT), Pressure Differential Scanning Calorimetry (PDSC) (e.g. L85-99), MHT TEOST (ASTM D7097), and TEOST 33C (ASTM D6335).

TABLE 2

Lubricating Compositions[1]

| | EX1 | EX2 | EX3 | EX4 | EX5 | EX6 | EX7 |
|---|---|---|---|---|---|---|---|
| Group III Base Oil | | | | Balance to 100% | | | |
| Dispersant[2] | 0.8 | 0.8 | 0.8 | 0.8 | 0.8 | 0.8 | 0.8 |
| Borated Dispersant[3] | 1.6 | 1.6 | 1.6 | 1.6 | 1.6 | 1.6 | 1.6 |
| Ca Sulfonate[4] | 0.4 | 0.4 | 0.4 | 0.4 | 0.4 | 0.4 | 0.4 |
| Mg Sulfonate[5] | 0.46 | 0.46 | 0.46 | 0.46 | 0.46 | 0.46 | 0.46 |
| Diarylamine Antioxidant | 1.15 | 1.15 | 1.15 | 1.15 | 1.15 | 1.15 | 1.15 |
| Sulfurized olefin | 0.3 | 0.3 | 0.3 | 0.3 | 0.3 | 0.3 | 0.3 |
| ZDDP | 0.75 | 0.38 | 0 | 0 | 0 | 0 | 0 |
| Molybdenum Dithiocarbamate | 0.025 | 0.025 | 0.025 | 0.025 | 0.025 | 0.025 | 0.025 |
| Polymeric VI Improver | 0.9 | 0.9 | 0.9 | 0.9 | 0.9 | 0.9 | 0.9 |
| Other Additives[6] | 0.22 | 0.22 | 0.22 | 0.22 | 0.22 | 0.22 | 0.22 |
| EXA | 0 | 0 | 0.84 | 0 | 0 | 0 | 0 |
| EXB | 0 | 0 | 0 | 0.74 | 0 | 0 | 0 |
| EXC | 0 | 0 | 0 | 0 | 0.53 | 0 | 0 |
| EXD | 0 | 0 | 0 | 0 | 0 | 1.35 | 0 |
| EXE | 0 | 0 | 0 | 0 | 0 | 0 | 0.78 |
| Calcium (ppm) | 790 | 780 | 750 | 770 | 790 | 780 | 760 |
| Magnesium (ppm) | 720 | 720 | 740 | 740 | 780 | 750 | 760 |
| Phosphorus (ppm) | 710 | 340 | 770 | 740 | 730 | 740 | 740 |
| Zinc (ppm) | 760 | 370 | 0 | 0 | 0 | 0 | 0 |
| Molybdenum (ppm) | 50 | 50 | 50 | 50 | 50 | 50 | 50 |
| Boron (ppm) | 155 | 150 | 150 | 150 | 150 | 150 | 150 |
| Sulfur (ppm) | 2180 | 1460 | 820 | 1820 | 750 | 775 | 2320 |
| KV100 ($m^2/s$) | 8.35 | 8.47 | 8.43 | 8.5 | 8.5 | 8.5 | 8.4 |

[1]All treat rates are oil free, unless otherwise noted

[2]Polyisobuyenylsuccinimide prepared from high vinylidene PIB (2000 Mn PIB; TBN 26 mg KOH/g)

[3]Borated polyisobutenylsuccinimide (2000 Mn PIB; TBN 26 mg KOH/g; 0.8 wt % Boron)

[4]Overbased calcium alkylbenzene sulfonate (TBN 520 mg KOH/g; 20 wt % Ca)

[5]Overbased magnesium alkylbenzene sulfonate (TBN 690 mg KOH/g; 16 wt % Mg)

[6]Other additives include friction modifiers, corrosion inhibitors, pourpoint depressants, and foam inhibitors)

TABLE 3

| LSPI Testing | | | | | | | |
|---|---|---|---|---|---|---|---|
| Ford Ecoboost Test | EX1 | EX2 | EX3 | EX4 | EX5 | EX6 | EX7 |
| LSPI events | 0.56 | 2.71 | 0.29 | 0.09 | 0.63 | nd | 6.58 |

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Unless otherwise stated herein, reference to treat rates or amounts of components present in the lubricating compositions disclosed herein are quoted on an oil free basis, i.e., amount of active.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character including one or more double bonds. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and components within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, or compositions, which can, of course, vary. It is also to be understood that the terminology used herein is for the purpose of describing particular embodiments only and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure may be described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 wt. % refers to groups having 1, 2, or 3 wt. %. Similarly, a group having 1-5 wt. % refers to groups having 1, 2, 3, 4, or 5 wt. %, and so forth, including all points therebetween.

Moreover, where a recited range for a treat rate is provided, it is contemplated that such range shall include treat rates for individual components and/or a mixture of components. Thus, for example, a range of 1 to 3 wt % contemplates that a given component may be present in a range of 1 to 3 wt % or that a mixture of similar components can be present in a range from 1 to 3 wt %.

As used herein, the term "about" means that a value of a given quantity is within ±20% of the stated value. In other embodiments, the value is within ±15% of the stated value. In other embodiments, the value is within ±10% of the stated value. In other embodiments, the value is within ±5% of the stated value. In other embodiments, the value is within ±2.5% of the stated value. In other embodiments, the value is within ±1% of the stated value.

Unless otherwise stated, "wt %" as used herein shall refer to the weight percent based on the total weight of the lubricating composition on an oil-free basis.

What is claimed is:

1. A method for reducing low speed pre-ignition in an engine, comprising suppling to a spark-ignited direct injection internal combustion engine a lubricant composition comprising:

a base oil of lubricating viscosity;

an ashless phosphorus-containing antiwear agent, wherein the ashless phosphorous containing antiwear agent comprises an alkyl (thio)phosphate amine salt, wherein at least 30 mole percent of phosphorous atoms in the alkyl (thio)phosphate amine salt are in an alkyl pyrophosphate salt structure;

an alkaline earth metal detergent:

an ashless antioxidant; and an ashless dispersant, where the lubricant composition is substantially free of zinc.

2. The method of claim 1, wherein the oil of lubricating viscosity comprises 80 to 95 wt % of the lubricant composition.

3. The method of claim 1, wherein the amine alkyl pyrophosphate salt comprises a species represented by formula (I) or (II):

(I)

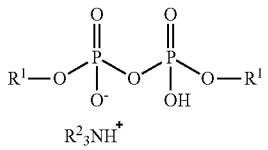

or (II)

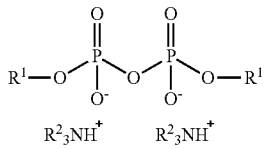

wherein each $R^1$ is independently a primary alkyl group of about 3 to about 12 carbon atoms and each $R^2$ is independently hydrogen or a hydrocarbyl group or an ester-containing group, and at least one $R^2$ group is a hydrocarbyl group or an ester-containing group; or wherein the —OH group is replaced by an —$OR^1$ group, or wherein one or more —$OR^1$ groups are replaced by —OH groups, or wherein an $R^1$ group is replaced by a phosphorus-containing group.

4. The method of claim 1, wherein the amine alkyl pyrophosphate salt comprises a species represented by formula (I) or (II):

(I)

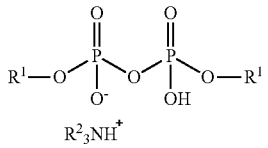

or (II)

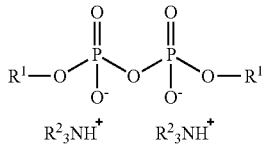

wherein each $R^1$ is independently a primary alkyl group of about 3 to about 12 carbon atoms and each $R^2$ is independently hydrogen or a hydrocarbyl group or an ester-containing group, and at least one $R^2$ group is a hydrocarbyl group or an ester-containing group.

5. The method of claim 1, wherein the ashless phosphorus-containing antiwear agent is present in the lubricant composition in amount of from 0.1 to 1.5 wt %.

6. The method of claim 1, wherein the ashless phosphorus-containing antiwear agent is present in amount to deliver from 500 to 900 ppm phosphorous to the lubricant composition.

7. The method of claim 1, wherein the alkaline earth metal detergent is selected from an alkaline earth metal sulfonate, phenate, and salicylate.

8. The method of claim 7, wherein the metal of the alkaline earth metal detergent is selected from calcium and magnesium.

9. The method of claim 8, wherein the alkaline earth metal detergent is a calcium sulfonate detergent.

10. The method of claim 8, wherein the alkaline earth metal detergent is a magnesium sulfonate detergent.

11. The method of claim 1, wherein the alkaline earth metal detergent is present in the lubricant composition in an amount of from 0.3 to 2.5 wt %.

12. The method of claim 1, wherein the alkaline earth metal detergent comprises a mixture of alkaline earth metal detergents and the mixture is present in the lubricating composition in an amount of from 0.8 to 2.0 wt %.

13. The method of claim 12, wherein the mixture of alkaline earth metal detergents includes 0.4 to 0.8 wt % of a calcium sulfonate detergent and 0.6 to 1.1 wt % of a magnesium sulfonate detergent based on the total weight of the lubricant composition.

14. The method of claim 1, wherein the ashless antioxidant is selected from an arylamine, diarylamine, an alkylated arylamines, an alkylated diaryl amines, a phenols, a hindered phenols, a sulfurized olefins, and mixtures thereof.

15. The method of claim 14, wherein the antioxidant is an alkylated diarylamine.

16. The method of claim 14, wherein the antioxidant is a sulfurized olefin.

17. The method of claim 1, wherein the antioxidant is present in the lubricant composition in an amount of from 0.1 to 2.1 wt %.

18. The method of claim 14, wherein the antioxidant includes 0.8 to 1.3 wt % of an alkylated diarylamine and 0.1 to 0.5 wt % of a sulfurized olefin.

19. The method of claim 1, wherein the ashless dispersant is a polyisobutylene succinimide dispersant.

20. The method of claim 19, wherein the polyisobutylene succinimide dispersant is borated.

21. The method of claim 1, wherein the ashless dispersant is present in the lubricant composition in an amount of from 1 to 6 wt %.

22. The method of claim 1, wherein the ashless dispersant includes 0.8 to 1.6 wt % of a boron free polyisobutylene succinimide dispersant and 1.8 to 3.1 wt % of a borated polyisobutylene dispersant.

23. The method of claim 1, wherein the ashless phosphorus-containing antiwear agent contains sulfur and the ratio of sulfur to phosphorous is less than 2 to 1.

24. The method of claim 1, wherein the engine is operated under a load with a break mean effective pressure (BMEP) of greater than or equal to 10 bars and at speeds less than or equal to 3,000 rpm.

25. The method of either claim 1, wherein the engine is fueled with a liquid hydrocarbon fuel, a liquid nonhydrocarbon fuel, or mixtures thereof.

* * * * *